US008056294B2

(12) United States Patent
LaLonde

(10) Patent No.: US 8,056,294 B2
(45) Date of Patent: Nov. 15, 2011

(54) CONCEALED SUSPENSION CEILING WITH DOWNWARD REMOVABLE PANELS

(75) Inventor: Paul D. LaLonde, Avon, OH (US)

(73) Assignee: USG Interiors, Inc., Chicago, IL (US)

( * ) Notice: Subject to any disclaimer, the term of this patent is extended or adjusted under 35 U.S.C. 154(b) by 0 days.

(21) Appl. No.: 12/330,956

(22) Filed: Dec. 9, 2008

(65) Prior Publication Data

US 2010/0139189 A1 Jun. 10, 2010

(51) Int. Cl.
*E04B 9/00* (2006.01)

(52) U.S. Cl. ..... 52/506.09; 52/506.08; 52/766; 52/773; 52/774; 52/778

(58) Field of Classification Search ..... 52/506.01, 52/506.06, 506.07, 506.08, 506.09, 766, 52/773, 774, 778

See application file for complete search history.

(56) References Cited

U.S. PATENT DOCUMENTS

| | | | | |
|---|---|---|---|---|
| 1,937,843 | A | 12/1933 | Randall | |
| 1,997,092 | A | 4/1935 | Duffy | |
| 2,005,427 | A | 6/1935 | Lenke | |
| 2,075,955 | A * | 4/1937 | Parsons | 52/204.599 |
| 2,164,138 | A | 6/1939 | London | |
| 3,023,865 | A | 3/1962 | Brandstetter | |
| 3,077,057 | A | 2/1963 | Forkin | |
| 3,175,656 | A | 3/1965 | Schoenfeld | |
| 3,228,163 | A | 1/1966 | Lindstrom | |
| 3,548,556 | A | 12/1970 | Vermeulen | |
| 3,693,303 | A | 9/1972 | Downing, Jr. et al. | |
| 3,832,816 | A * | 9/1974 | Jahn | 52/779 |
| 3,969,865 | A * | 7/1976 | Andersen | 52/506.07 |
| 4,027,454 | A | 6/1977 | Schuplin | |
| 4,063,391 | A | 12/1977 | Balinski et al. | |
| 4,470,239 | A * | 9/1984 | Sauer | 52/777 |
| 4,505,083 | A | 3/1985 | Mieyal | |
| 4,640,064 | A * | 2/1987 | Goodworth, II | 52/506.08 |
| 5,024,034 | A | 6/1991 | Gailey | |
| 5,761,869 | A | 6/1998 | Tinen et al. | |
| 6,108,994 | A | 8/2000 | Bodine | |
| 6,230,463 | B1 | 5/2001 | Bodine | |
| 6,260,325 | B1 * | 7/2001 | Wendt et al. | 52/506.07 |
| 6,389,771 | B1 * | 5/2002 | Moller | 52/506.06 |
| 6,513,295 | B2 | 2/2003 | Bernardino | |
| 6,925,764 | B2 * | 8/2005 | Hrovath et al. | 52/390 |

OTHER PUBLICATIONS

Notification of Transmittal of the International Search Report and the Written Opinion of the International Searching Authority, or the Declaration, International Search Report dated Jun. 17, 2010, Written Opinion of the International Searching Authority dated Jun. 17, 2010 for corresponding PCT/US2009/063665, filed Nov. 9, 2009.

* cited by examiner

*Primary Examiner* — Brian Glessner
*Assistant Examiner* — Adam Barlow
(74) *Attorney, Agent, or Firm* — Pearne & Gordon LLP

(57) ABSTRACT

A suspended ceiling system comprising metal grid members and rectangular composite acoustical panels, the panels having edges at their peripheries, the grid members having a cross section generally like an inverted T such that they provide oppositely extending flanges adapted to support the panels at their edges, a resilient element at a juncture between a support on the grid member flanges and at least one edge of each panel, the resilient element being arranged to temporarily deflect to permit a panel to be raised from below the grid member into an installed position and to extend itself to hold such panel in position on the grid.

7 Claims, 5 Drawing Sheets

FIG. 7A
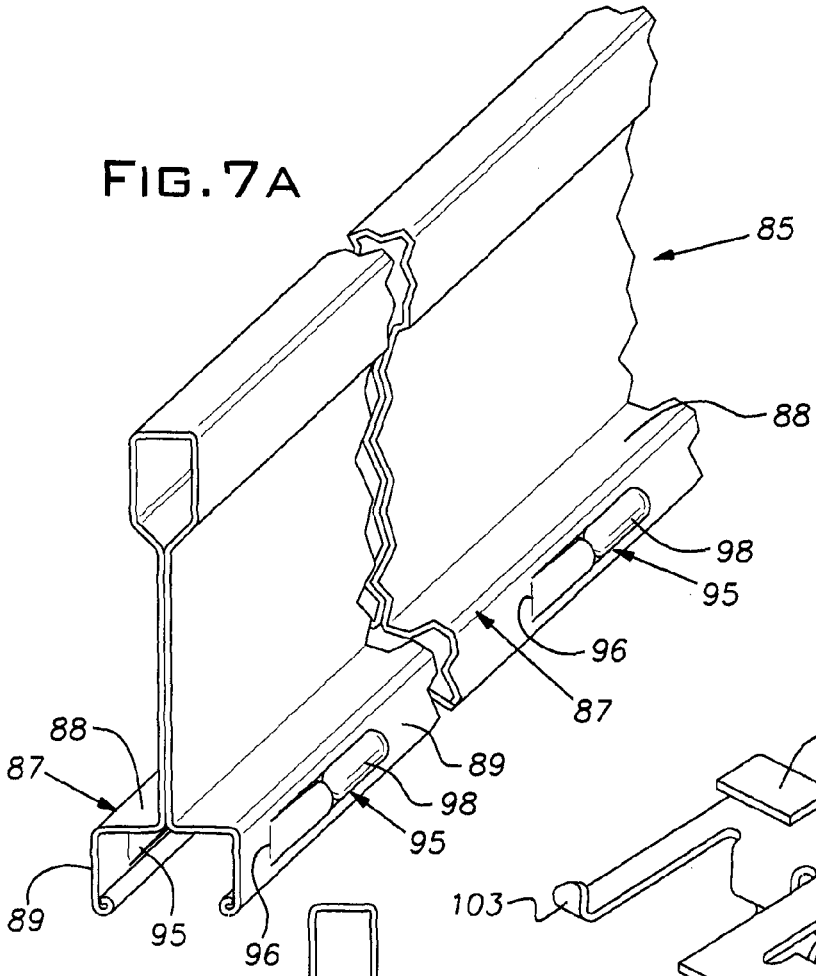
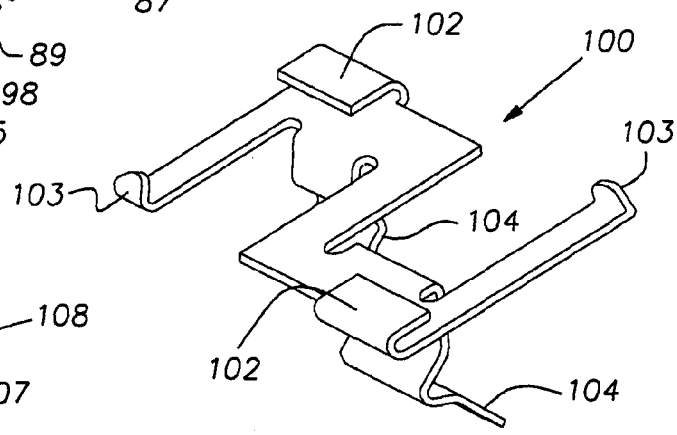
FIG. 9
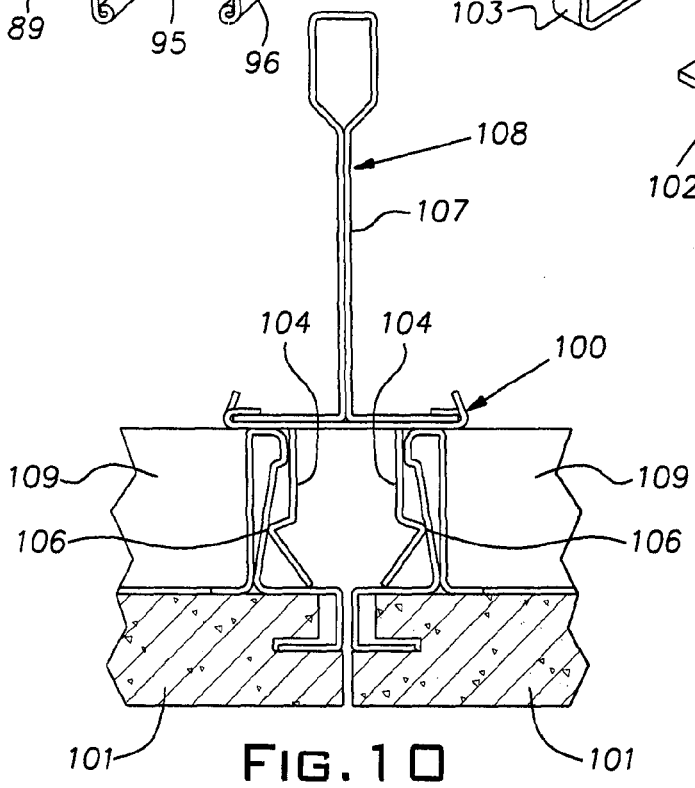
FIG. 10

CONCEALED SUSPENSION CEILING WITH DOWNWARD REMOVABLE PANELS

The invention relates to suspended ceiling constructions and, in particular, to systems in which ceiling panels are downwardly removable from a suspended grid.

BACKGROUND OF THE INVENTION

Suspended ceilings ordinarily comprise a rectangular metal grid and panels or tiles that are set in the grid spaces from the plenum above the plane of the grid. While this installation technique allows the grid elements and panels to take simple forms, it requires some minimum overhead clearance and usually leaves the lower face of the grid elements fully exposed. These characteristics can limit the places where these ordinary systems can be used as well as the aesthetics of such installations.

SUMMARY OF THE INVENTION

The invention provides grid and panel components for suspended ceilings that allow the panel to be installed and removed from the grid by movement through the space below the ceiling. The invention relies on laterally resilient elements disposed where the edges of the panels are supported by the surfaces of the grid members. In some embodiments of the invention, the resilient elements are situated on the grid members while in other embodiments the resilient elements are situated on the panel. The resilient elements are preferably located at two opposite edges, at least, of each panel. One or both of the interengaging surfaces of the grid and panel edge can be configured to develop a camming action to produce lateral movement of the resilient element and thereby enable installation or removal of the panel on or off the grid when the panel is forced upwardly or downwardly. In some disclosed arrangements, the configuration produces a camming action during both upward panel installation movement and downward panel removal movement.

BRIEF DESCRIPTION OF THE DRAWINGS

FIG. 7A is an isometric view of still another variant of the grid tee illustrated in FIG. 6;

FIG. 9 is an isometric view of a grid tee clip;

FIG. 10 is a cross-sectional view of the clip of FIG. 9 shown in an installed position on a supporting grid tee of complementary configuration;

DESCRIPTION OF THE PREFERRED EMBODIMENTS

The grid members described herein will be typically formed of rolled sheet metal strips of steel or aluminum as is customary in the industry. The grid members, commonly, have the general cross-sectional shape of an inverted T with the bottom having a panel supporting flange and the top having a hollow reinforcing bulb. The grid members or tees, in a customary manner, are arranged in a rectangular grid, ordinarily using long main runners and short cross runners. The grid module, for example, can be 2'×2' or 2'×4', or metric equivalent, as well as other desired sizes. It will be well understood that the various tees disclosed herein can be used in only one direction, with conventional tee shapes in the other direction, so that a rectangular panel is supported on two opposite edges or, alternatively, can be used in both directions so that the panel is supported on all four edges. The ceiling panels described herein are typically rectangular (which term includes square) composite boards having desired mechanical and acoustic properties and are of known composition. In all of the disclosed embodiments, at least two opposite edges of a panel have a special form for cooperating with resilient elements on the adjacent grid members or themselves constitute or integrate the resilient elements.

Figure 1:
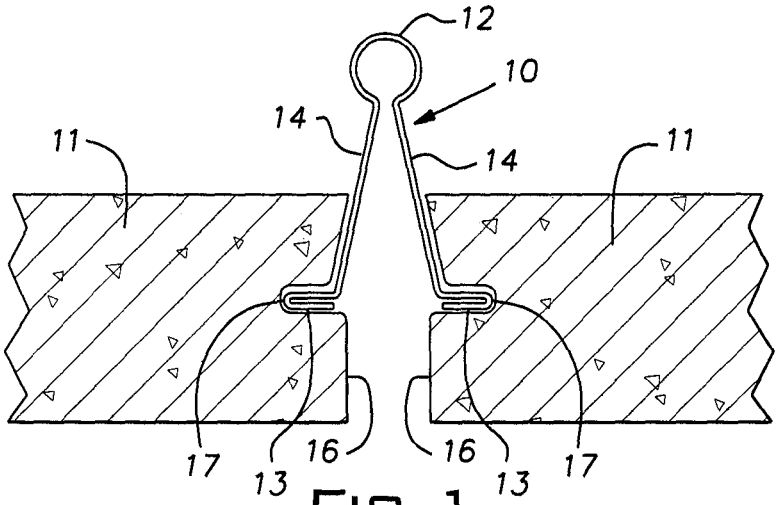
FIG. 1 is a fragmentary cross-sectional view of a novel grid tee and ceiling panel construction for a suspended ceiling capable of downward access.

Referring now to FIG. 1, there is shown, in cross-section, a grid runner or tee 10 and a pair of ceiling panels 11. The grid tee 10 has a hollow reinforcing bulb 12 running along its upper edge and oppositely extending panel supporting flanges 13 along its lower edge or bottom. Web or stem layers 14 extend generally vertically between the bulb 12 and flanges 13. In the illustrated example, the flanges are in the form of U-shaped channels with the bight of the U distal from its associated web 14. Edges 16 of the panels 11 have grooves or pockets 17 that receive respective flanges 13. The tee 10 is roll-formed or otherwise fabricated such that in its free state, as shown in FIG. 1, the web layers 14 diverge from one another, their spacing increasing with increasing distance from the bulb 12. The panels or tiles 11 can be released from the grid formed by the tees 10 by squeezing the tees to bring the web layers 14 together so that at least one of the flanges 13 is withdrawn from its respective groove 17 and the associated panel 11 is allowed to drop vertically downwardly for access to the plenum above the plane of the ceiling.

Figure 2:
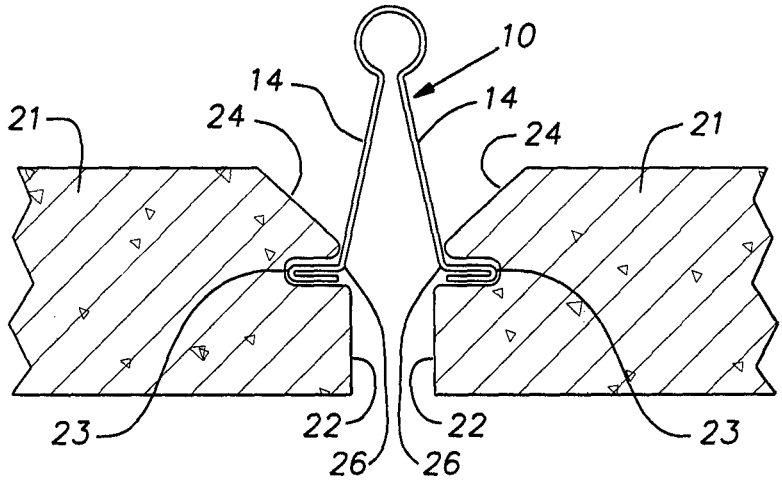
FIG. 2 is a view similar to FIG. 1 of a modified ceiling panel.

FIG. 2 illustrates a grid tee, which can be of the same configuration as the tee disclosed in FIG. 1 and ceiling panels 21 of a modified edge profile from that illustrated in FIG. 1. Edges 22 of the panel include grooves 23 for receiving the tee flanges 13. Above the grooves 23 the edges are angled or beveled at 24. This angled construction allows the surfaces 24 to cam their respective flanges 13 inwardly when the panels are pushed upwardly during the installation process. That is, the panels 21 can be installed on the tees 10 from below by a push-up motion in which the bevels 24 operate to resiliently deflect a flange and associated web layer 14 until the panel 21 is in its vertical installed position and the flange 13 can snap into the groove 23. Small holes or slots 26 can be provided in the vicinity of the juncture between the flanges 13 and their respective web layers 14 to enable a tool to be inserted therein from below the ceiling and through a gap between the adjacent panels 21 to deflect a web layer 14 towards its opposite web layer to release the flange 13 from the groove 23 and, therefore, the panel 21 from the tee 10.

Figure 3:
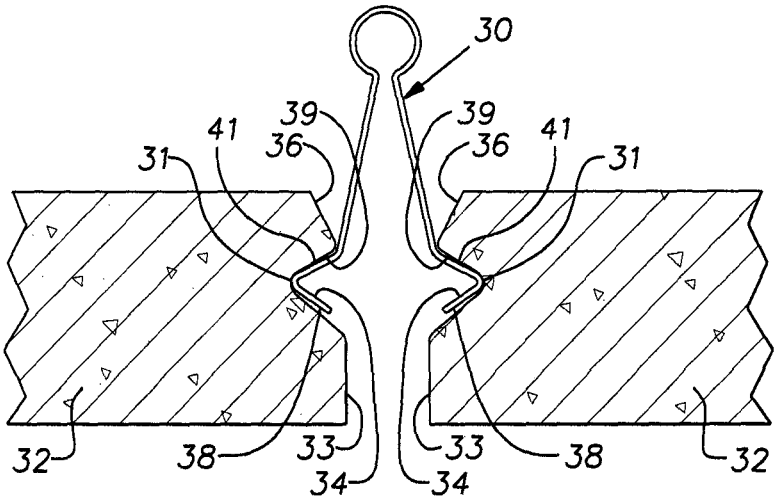
FIG. 3 is a view similar to FIG. 1 of yet another modification of a ceiling panel and a grid tee.

Referencing FIG. 3, a grid tee 30 differs from that shown in FIGS. 1 and 2 in that its flanges 31 are more bulbous or rounded than that previously shown. Ceiling panels 32 have edges 33 with V-shaped grooves or pockets 34 and a beveled or chamfered upper zone 36. An inclined surface 38 of a lower part of the flange 31 engages the surface of the bevel 36 when a panel 32 is pushed upwardly during installation with the result that flange 31 and web 35 are deflected inwardly until the flange snaps into the groove 34 for installation of the panel from the space below the grid tee. An inclined surface 39 of the groove 34 bears against an inclined surface 41 on the upper part of the flange 31 to cam the flange and web 35 inwardly to displace the flange from the groove when the panel 32 is pulled downwardly and is thereby released from the installed position.

Figure 4:
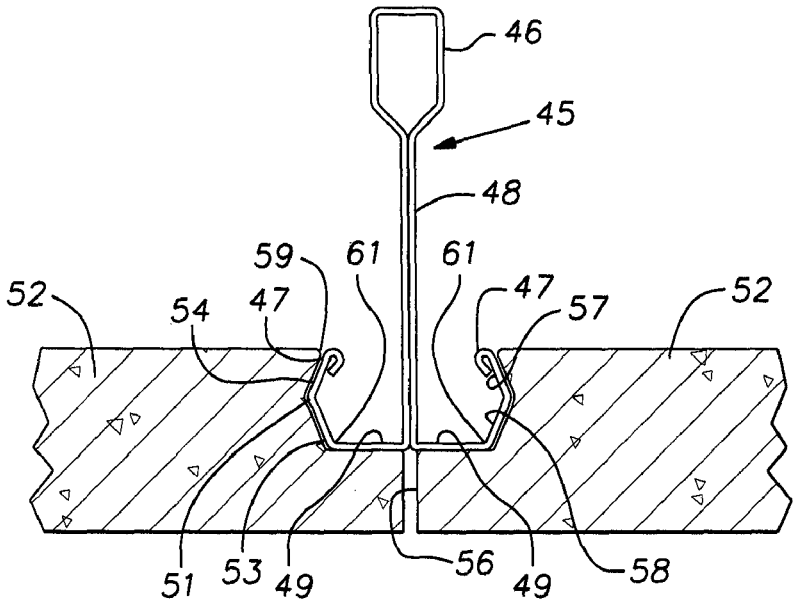
FIG. 4 is a cross-sectional view of a grid tee and ceiling panel construction of a still further modification.

At FIG. 4, a grid tee 45 is shown having the hollow reinforcing bulb 46 at its top and a panel supporting flange 47 at its bottom. Disposed between the bulb 46 and flange 47 is a double wall or layer web 48. The flange 47 has symmetrical sections to the right and left of the web as viewed in FIG. 4. Each of the flange sections has a horizontal portion 49 extending from the web 48 and an upturned portion 51 distal from the web. The upturned portion 51 is convex relative to a corresponding ceiling panel 52 by virtue of an outwardly inclined section 53 and an inwardly inclined section 54. The grid tee 45 is illustrated in its free state or essentially in its free state. A ceiling panel 52 has an edge configuration which is complementary to the corresponding section of the flange 47. In particular, an edge 56 includes an outwardly flared or directed surface 57 and an inwardly flared or directed surface 58. The surfaces 57, 58 form a shallow groove or pocket for receiving the tee flange portion 51. The material of the grid tee 45 is sufficiently resilient to enable the sides of the flange 47 to flex inwardly to enable the panel 52 to be pushed into place for installation from below the plane of the ceiling and be pulled downwardly for access to the plenum above the ceiling. During installation, the outwardly inclined flange section 53 serves as a cam when engaged by a corner 59 of the panel 52 to force the flange portion 51 inwardly for installation of the panel 52. For dismounting or removal of the panel 52, the flared panel surface 57 working as a cam against the flange surface 54 forces the flange section 51 laterally inwardly to permit the panel to be pulled off the grid tee 45. The flange 47 can be slit, notched, or otherwise weakened at points 61, for example, to assure that the flange will flex for installation or removal of a panel 52 without excessive compressive forces being applied against the panel which could otherwise damage it.

Figure 5:
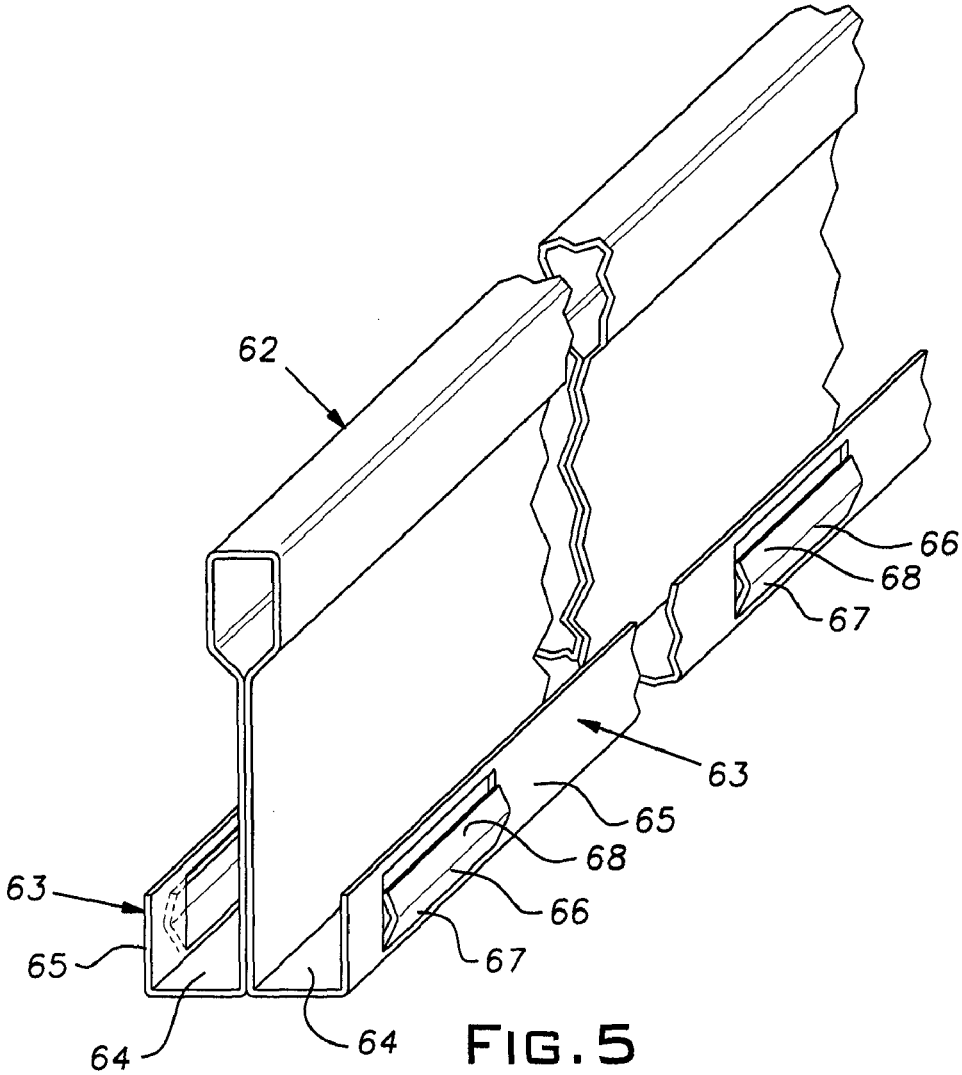
FIG. 5 is an isometric view of a variant of the grid tee illustrated in FIG. 4.

FIG. 5 illustrates a grid tee 62 similar in function to that of the tee 45 illustrated in FIG. 4. In this instance, flange sections 63 are L-shaped having a horizontal portion 64 and a vertical portion 65. Spaced longitudinally along the vertical flange portion 65 are a series of regularly spaced projections 66 stamped from the plane of the vertical portion. The projections have inclined surfaces 67, 68 which function as the corresponding surfaces 53, 54 of the grid tee 45 of FIG. 4. The grid tee 62 can be used with the panel 52 shown in FIG. 4 and mounting and dismounting of the panel can be accomplished in the manner described in connection with FIG. 4.

Figure 6:
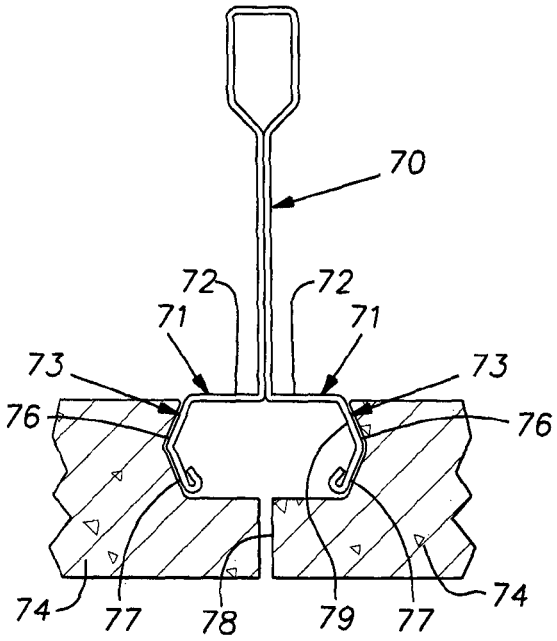
FIG. 6 is a fragmentary cross-sectional view of a still further grid tee and ceiling panel constructed in accordance with the invention.

FIG. 6 illustrates a variation of a grid tee 70. Flange sections 71 of the grid tee 70 are inverted from the orientation of the flange sections described in connection with FIG. 4. The flange sections 71 include a horizontal portion 72 and a vertical portion 73 depending from the horizontal portion. The vertical portion 73 is convex in relation to ceiling panels 74 by virtue of an outwardly extending portion 76 and an inwardly extending portion 77. The ceiling panels 74 have their edges shaped to conform to the profile of the flange sections 71. Specifically, an edge 78 of a panel 74 has a V-shaped groove 79 proportioned to fit against the outward and inward section 76, 77 of the vertical flange portion 73. A panel 74 can be installed or removed from the grid tee 70 by pushing it into place or pulling it from its installed position in the same way as described in connection with the grid tee 45 and panel 52 shown in FIG. 4.

Figure 7:
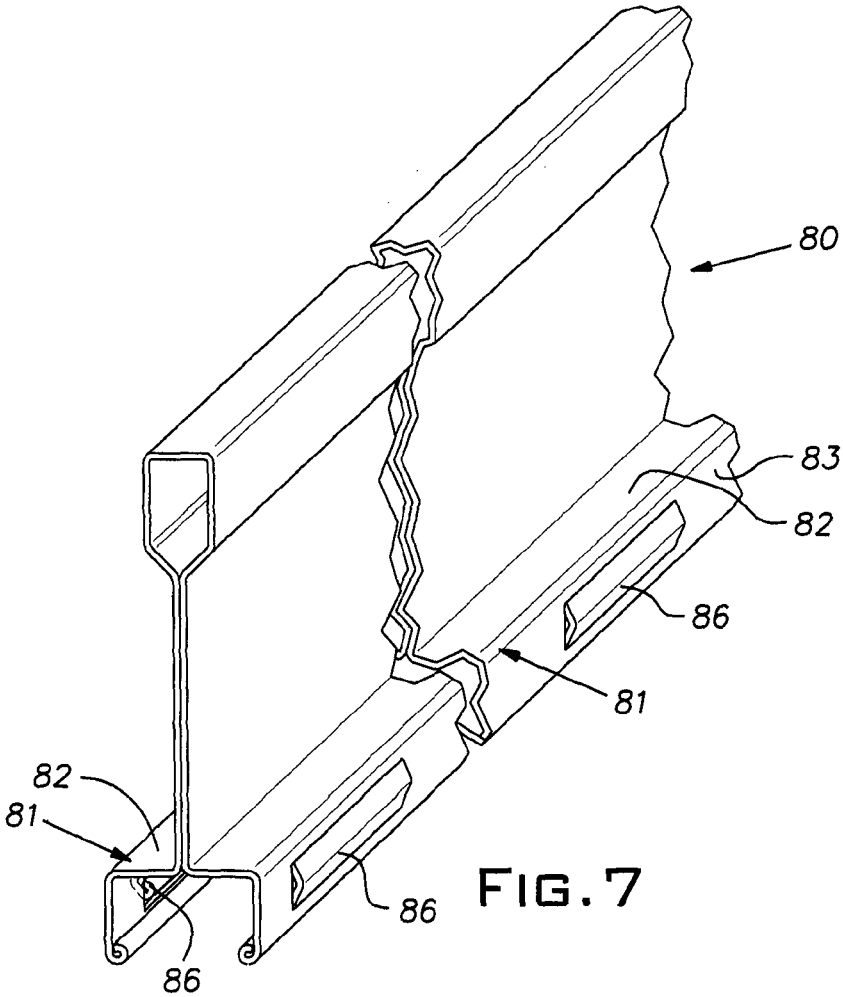
FIG. 7 is an isometric view of a variant of the grid tee illustrated in FIG. 6.

FIG. 7 illustrates a grid tee 80 analogous to the grid tee 62 of FIG. 5. The grid tee 80 has flange sections 81 which include a horizontal portion 82 and a vertical portion 83 depending from the horizontal portion and distal from the grid tee web 84. Projections 86 are stamped out of the vertical portions 83. The projections are spaced along the length of the grid tee 80 and have a profile when the tee is viewed endwise similar to that of FIG. 6. The grid tee 80 can be used with the ceiling panel 74 of FIG. 6 or panel 52 of FIG. 4 in the manner of installation and removal described in connection with those figures.

FIG. 7A illustrates a modified grid tee 85 similar to the tee 80 of FIG. 7. Flange sections 87 include horizontal portions 88 and vertical portions 89. Resilient grips 95 are integrally formed on the vertical portions 89 at spaced locations along the length of the grid tee 85. The grips 95, being cut out of the vertical portion 89 on three sides to leave an integral hinge 96, are relatively long compared to their vertical dimension, including the vertical length of the hinge. The short vertical length of the hinge 96 and the relatively long distance from a bulbous free end 98 of the grip 95 results in a relatively soft spring, i.e. a low force required for deflection of the grip. The resulting soft action of the grips 95 permits them to readily deflect when a panel such as illustrated in FIG. 6 is pushed up for installation and pulled down for dismounting, thereby avoiding excessive force and possible damage to the panel.

Figure 8:
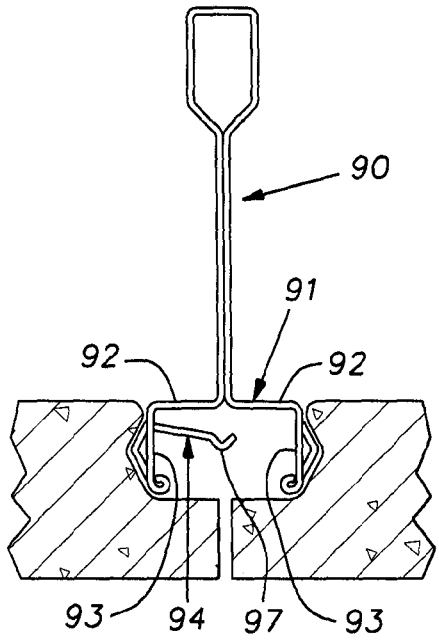
FIG. 8 is a cross-sectional view of a grid tee constructed in accordance with the invention.

FIG. 8 illustrates a modified form of grid tee 90. Flange section 91 includes horizontal portions 92 and vertical portions 93. Spaced along the length of the grid tee 90 are sheet metal spring clips 94 disposed in associated elongated slots stamped in the upper region of the vertical flange parts 93. A portion of the clip 94 outside of the flange section 91 serves the purpose of the projections 86 of the grid tee 80 (FIG. 7) to accept and retain a panel 52, 74 such as shown in FIGS. 4 and 6. Within the flange sections 91 a clip 94 has an integral arm 97. The arm 97 can be manipulated with a tool inserted between adjacent panels to release a panel by causing the part of the clip 94 external of the flange section 91 to flatten against the vertical flange part 93.

FIGS. 9 and 10 illustrate a twist-on clip 100 for suspending ceiling panels 101. The clip 100 is proportioned to be mounted on the lower face of standard grid tees, typically having a face width of 15/16'. The clip 10 can be stamped from steel sheet stock and hardened before or after stamping so as to have a spring-like character. The clip 100 includes a pair of opposed grips 102 on diagonally opposite corners and a pair of stops 103 on its other diagonally opposite corners. Depending from the original plane of the body of the clip 100 are a pair of opposed legs 104. The legs 104 each have a projection 106 that extends laterally with respect to a plane of its associated leg 104 which, when installed on a grid tee is parallel to a plane of a web 107 of a tee 108 on which it is installed (FIG. 10). A panel 101 has a roll-formed metal molding, of light gauge steel 109, or an extrusion of plastic such as polyvinylchloride (PVC) affixed to its edge and extending upwardly above the upper side of the panel 101.

The molding 109 is mechanically attached to the panel by an appropriate fastening technique such as creating barbs in the body of the molding, use of separate staples, and/or use of adhesive. It will be understood that the panel 101 can be assembled on the clip 100 and its associated grid tee 108 by pushing it in place to cause the legs 104 to be cammed inwardly by contact of the upper corner of the molding 109 and the lower part of the projection 106. The legs 104 snap into the pocket formed by the outward flare of the molding 109. Conversely, the panel 101 can be dismounted from the installed position illustrated in FIG. 10 by pulling the panel downwardly to cause the upper part of the projection 106 to cam the leg 104 inwardly and thereby release the panel 101. During removal of a particular panel 101, the adjacent panel can be lifted above its normal resting position shown in FIG. 10 to provide a finger or tool hold of the panel being removed.

Figure 11:
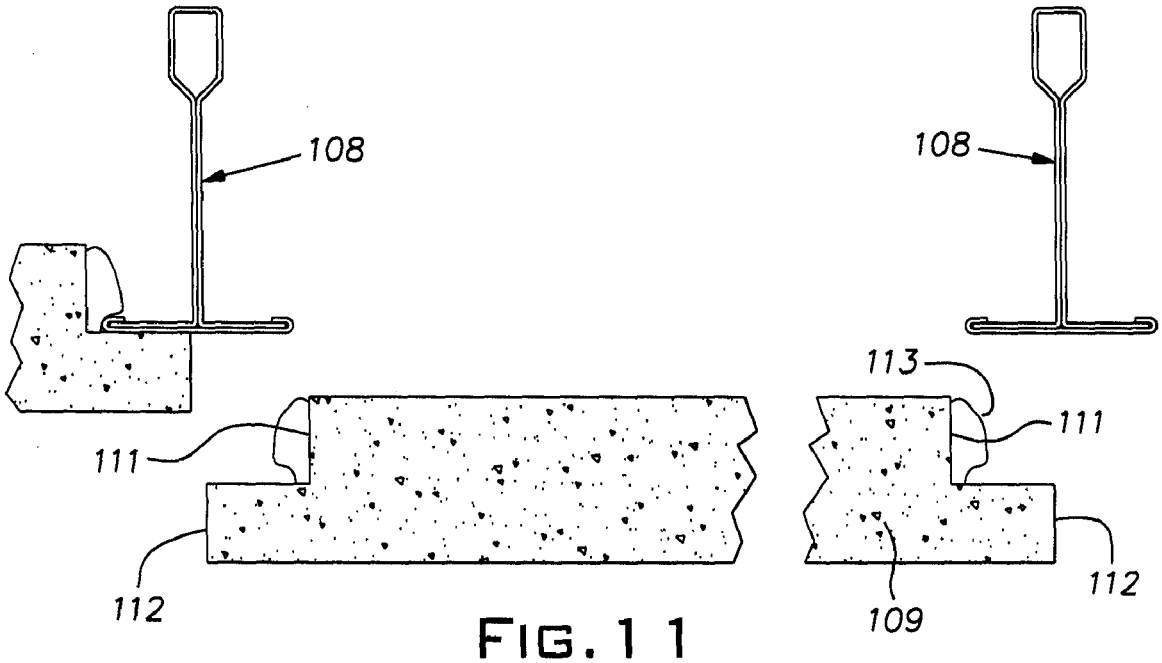
FIG. 11 is a cross-sectional view of a grid tee and a novel ceiling panel.

With reference to FIG. 11, there is shown conventional grid tees 108 and a novel ceiling panel 109. The base of the panel 109 is made of conventional ceiling panel stock. The edge of the panel 109 is rabbeted such that it includes a vertical surface 111 recessed from the outwardmost edge 112 of the panel. Affixed to the rabbet surface 111 is a resilient foam edge 113. The rabbeted edges of the panel 109 and the resilient foam edges 113 are proportioned such that the panel can be pushed up between a pair of regularly spaced parallel grid tees 108. During this push-up installation motion, the resilient foam edge 113 is resiliently compressed so that it can pass through the space between the flanges of the grid tees 108. When the panel 109 abuts the lower face of the grid tee 108, the resilient foam edge expands to its free state such that it overlies the adjacent part of the grid tee flange and thereby holds the panel in place. The resilient foam edge 113 can be an extrusion or a molded part either formed in place on the panel 109 or adhered to the panel with a suitable adhesive.

Figure 12:
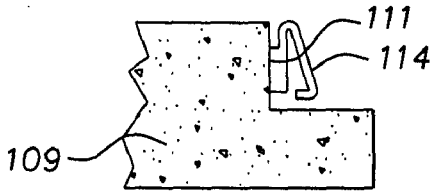
FIG. 12 is a cross-sectional view of the edge detail of a grid tee in a still further variation of a ceiling panel.

FIG. 12 illustrates an alternative to the design illustrated in FIG. 11. The panel 109 has a clip 114 secured to its vertical surface 111. The clip 114 can be a suitable extruded plastic such as PVC or like material having resilient properties enabling it to work as a spring. The plastic strip 114 can be continuous along the length of the associated panel 109 and is adhesively or mechanically attached to the vertical surface 111 of the rabbeted edge of the panel 109. The strip or clip 114 is provided on at least two opposite edges of the panel 109. The assembly of the panel 109 and clips 114 can be installed on a suspended grid from below the plane of the grid in the manner described in connection with FIG. 11.

Figure 13:
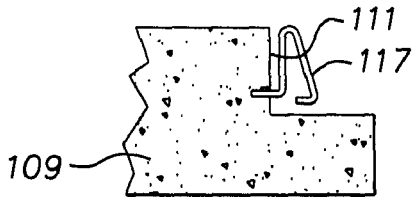
FIG. 13 is a cross-sectional view of the edge detail of a modified form of ceiling panel similar to that shown in FIG. 12.

Referring now to FIG. 13, a ceiling panel 109 has a light gauge metal spring 117 attached to its vertical surface 111. The spring 117 which can run continuously along the vertical surface 111 or can be provided in spaced segments is mechanically attached to the panel 109 with integral barbs, staples, or adhesive, as desired. The metal spring 117 has a shape when viewed along the direction that the vertical surface extends analogous to the shape of the plastic strip 114 disclosed in FIG. 12. This enables the assembly of the panel 109 and spring 117 to be used in the same manner as described in connection with FIGS. 11 and 12 such that the panel 109 can be assembled from below the plane of the grid.

Figure 14:
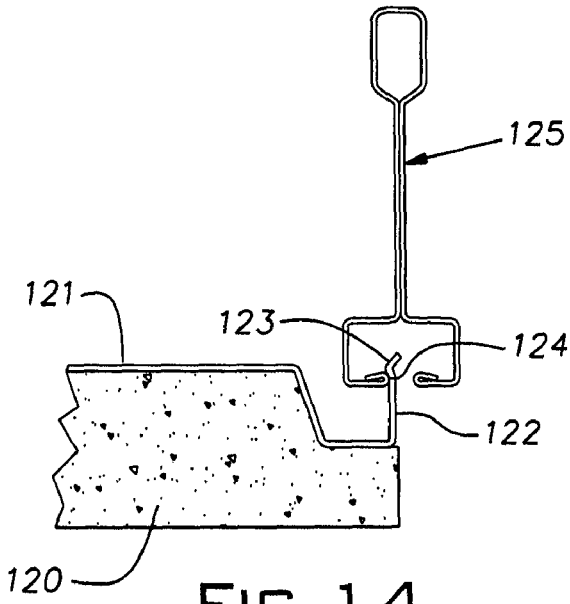
FIG. 14 is a fragmentary cross-sectional view of a grid tee and a ceiling panel of unique construction embodying the invention.

With reference to FIG. 14, a ceiling panel 120 is clad with a light gauge metal sheet 121. The metal sheet 121 has an inverted pan shape. The periphery of the cladding sheet 121 is formed with a vertical flange 122. The flange 122 is bent inwardly to form a rib or bead 123. The flange 122 and its bead 123 are proportioned to releasably catch on a slot edge 124 of a conventional slot type grid tee 125.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

What is claimed is:

1. A suspended ceiling system comprising elongated metal grid members and rectangular composite acoustical panels, the panels having edges at their peripheries, the grid members having a cross section generally with the shape of an inverted T such that they provide a vertical web and flanges extending from opposite sides of the vertical web, the flanges having a horizontal portion adjacent the web and a vertical portion distal from the web, the flanges being adapted to support the panels at the edges of the panels, a resilient element provided on the vertical portion of each flange away from the web, the resilient element being arranged to be temporarily resiliently deflected by a camming action with a contacting edge of a panel with forcible upward movement of the panel to permit the panel to be raised from below the grid member into an installed position and to extend itself to hold such panel in position on the grid, and to be temporarily resiliently deflected by a camming action with a contacting edge of a panel with forcible downward movement of the panel to permit the panel to be removed, in the installed position a portion of the panel edge underlying the resilient element.

2. A suspended ceiling system as set forth in claim 1, wherein said resilient element is formed by a grid member.

3. A suspended ceiling system as set forth in claim 2, wherein the grid member flanges have a pair of generally vertical faces, at least a portion of said faces being resiliently deflectable inward towards a vertical center line of the grid member to permit a panel to be installed.

4. A suspended ceiling system as set forth in claim 1, wherein the one panel edge is shaped with a pocket to receive at least a portion of the respective grid member flange.

5. A suspended ceiling system as set forth in claim 1, wherein the panel has a rabbetted edge and the resilient element is disposed in a hollow of the rabbetted edge.

6. A suspended ceiling system as set forth in claim 5, wherein the resilient element is a metal strip or clip.

7. An elongated grid runner for use in a rectangular suspended ceiling grid for supporting rectangular composite acoustical panels, the grid runner having the general shape of an inverted tee with a central vertical web and a pair of flanges extending in opposite directions away from a lower part of the web, the flanges having a horizontal portion adjacent the web and a vertical portion distal from the web, a resilient element on each of the vertical portions of the flanges remote from the web, the resilient element being arranged to be temporarily resiliently deflected by forcible upward movement of a panel to permit the panel to be raised from below the grid runner into an installed position and to extend itself to hold such panel in position on the grid, and to be temporarily resiliently deflected by forcible downward movement of the panel to permit the panel to be removed.

* * * * *

UNITED STATES PATENT AND TRADEMARK OFFICE

CERTIFICATE OF CORRECTION

PATENT NO. : 8,056,294 B2
APPLICATION NO. : 12/330956
DATED : November 15, 2011
INVENTOR(S) : Paul D. LaLonde It is certified that error appears in the above-identified patent and that said Letters Patent is hereby corrected as shown below:

At column 4, line 59, change 15/16' to -- 15/16" --.

Signed and Sealed this
Seventh Day of February, 2012

David J. Kappos

David J. Kappos
*Director of the United States Patent and Trademark Office*